US008573925B2

(12) United States Patent
Townes

(10) Patent No.: US 8,573,925 B2
(45) Date of Patent: Nov. 5, 2013

(54) COOLED COMPONENT FOR A GAS TURBINE ENGINE

(75) Inventor: Roderick M. Townes, Derby (GB)

(73) Assignee: Rolls-Royce PLC, London (GB)

( * ) Notice: Subject to any disclaimer, the term of this patent is extended or adjusted under 35 U.S.C. 154(b) by 730 days.

(21) Appl. No.: 12/785,747

(22) Filed: May 24, 2010

(65) Prior Publication Data

US 2010/0316486 A1 Dec. 16, 2010

(30) Foreign Application Priority Data

Jun. 15, 2009 (GB) ..... 0910177.5

(51) Int. Cl.
*F01D 25/12* (2006.01)

(52) U.S. Cl.
USPC ..... 415/115; 416/97 R; 416/191

(58) Field of Classification Search
USPC ..... 416/192, 193 R
See application file for complete search history.

(56) References Cited

U.S. PATENT DOCUMENTS

| | | | | |
|---|---|---|---|---|
| 6,190,130 | B1 * | 2/2001 | Fukue et al. | 416/97 R |
| 6,340,284 | B1 * | 1/2002 | Beeck et al. | 415/115 |
| 6,340,285 | B1 * | 1/2002 | Gonyou et al. | 415/116 |
| 6,354,795 | B1 * | 3/2002 | White et al. | 415/116 |
| 6,887,033 | B1 * | 5/2005 | Phillips et al. | 415/115 |
| 6,945,749 | B2 * | 9/2005 | De Cardenas | 415/115 |
| 7,665,955 | B2 * | 2/2010 | Liang | 415/115 |
| 2011/0171013 | A1 * | 7/2011 | Arzel et al. | 415/180 |

FOREIGN PATENT DOCUMENTS

| | | |
|---|---|---|
| EP | 1 074 695 A3 | 2/2001 |
| GB | 2 005 775 A | 4/1979 |
| GB | 2 239 679 A | 7/1991 |

* cited by examiner

*Primary Examiner* — Nathaniel Wiehe
*Assistant Examiner* — Jeffrey A Brownson
(74) *Attorney, Agent, or Firm* — Oliff & Berridge, PLC

(57) ABSTRACT

A cooled component for a gas turbine engine, the component includes a segment region defining a segment of an annulus for passage of hot gases therethrough, the segment region having a pair of opposed side faces configured to lie substantially adjacent respective corresponding side faces of segments of similar operationally and circumferentially adjacent components, wherein: the segment region includes an elongate cooling slot in at least one of the side faces, the cooling slot being arranged in fluid communication with at least one flow passage within the segment region for a supply of cooling fluid to the slot, and the slot is substantially closed at an upstream end of the slot and open at a downstream end of the slot so as to define an outlet for the cooling fluid at an operationally downstream region of the at least one of the side faces.

15 Claims, 9 Drawing Sheets

COOLED COMPONENT FOR A GAS TURBINE ENGINE

The present invention relates to a cooled component for a gas turbine engine. More particularly, the invention relates to a cooled component having a segment region defining a segment of an annulus for the passage of hot gases therethrough.

Conventional gas turbine engines comprise a compressor section which is configured to compress a flow of air passing through a core region of the engine. The resulting flow of compressed air is then mixed with fuel and the fuel is burned in a combustor which is located downstream of the compressor section, thereby producing a flow of hot compressed gas. The hot compressed gas is then directed into a turbine section and the hot gas expands through, and thereby drives, the turbine. As will be appreciated by those of skill in this field, the turbine section of a gas turbine engine typically comprises a plurality of alternating rows of stationary vanes and rotating blades. Each of the rotating turbine blades has an aerofoil portion and a root portion by which it is affixed to the hub of a rotor.

Because the turbine blades of a gas turbine engine are exposed to the hot gas discharged from the combustor section, the individual turbine blades must be cooled in order to maintain their structural integrity. Conventionally, the turbine blades are cooled by drawing off a portion of the compressed air produced by the compressor and directing that flow of air to the turbine section of the engine, thereby bypassing the combustor. The cooling air is directed outwardly through radial passages formed within the aerofoil portions of each of the turbine blades. It is now conventional to provide a large number of small outlet apertures over the surfaces of the aerofoil section, and in particular the concave pressure surface, in order to direct the cooling air from the radial passage within the aerofoil and over the surface of the aerofoil. As the cooling air exits the apertures formed in the blade surface, it thus washes over the surface of the turbine blade, thereby cooling the blade.

The efficiency of axial flow turbines is dependent upon the clearance gap between the radially outermost tip of each turbine blade and the casing which normally surrounds them. If this clearance gap is too large, then the hot gas exiting the combustor section and which drives the turbine of the engine will leak across the gap, thereby reducing the efficiency of the turbine. However, if the clearance gap is too small, then there will be a danger that under certain circumstances the blade tips could contact the surrounding casing resulting in damage.

One way of reducing this leakage is to provide each of the turbine blades with a shroud segment at its outermost tip such that when a plurality of such turbine blades are appropriately mounted in a circumferential manner around a rotor hub, the shroud members of adjacent blades co-operate to define an annular barrier to the gas leakage flow.

In order to provide an effective gas leakage barrier in this manner, and to minimise problems arising from the vibration of the turbine blades, it has been proposed to ensure that adjacent shroud members abut one another so that they cooperate in order to define a substantially rigid annular structure. As will be appreciated, such an arrangement necessitates the provision of a hard, wear resistant coating on abutting side faces of the shrouds. However, because of the very high operating temperature of the turbine section, it has been found that the shroud members, and in particular the coating material provided on the abutting side faces of neighbouring shroud members, can become damaged as a result of oxidation and burning, which can result in the loss of material in the region of the abutting shroud members. These effects can lead to the appearance of gaps between adjacent shroud members with a resultant reduction in turbine efficiency due to gas leakage through the gaps, and the occurrence of blade vibration problems.

There is therefore a need for a convenient and effective arrangement to cool the side faces of turbine blade shroud members, and it is therefore an object of the present invention to provide an improved cooled component for a gas turbine engine.

As will be explained in more detail below, whilst the cooled component of the present invention is particularly suitable for configuration in the form of a shrouded turbine blade, the cooled component can alternatively take the form of a nozzle guide vane, a seal segment or any other component having a region defining the segment of an annulus for the passage of hot gases through a gas turbine engine.

According to the present invention, there is provided a cooled component for a gas turbine engine, the component having a segment region defining a segment of an annulus for the passage of hot gases therethrough, said segment region having a pair of opposed side faces configured to lie substantially adjacent respective corresponding side faces of the segments of similar operationally and circumferentially adjacent components, said component being characterised by the provision of an elongate cooling slot in at least one of said side faces, said cooling slot being arranged in fluid communication with at least one flow passage within said segment region for the supply of cooling fluid to said slot, the slot being substantially closed at its upstream end and open at its downstream end so as to define an outlet for said cooling fluid at the operationally downstream region of said side face.

Preferably the cooled component takes the form of a shrouded turbine blade in which said segment region defines an integral shroud portion of the turbine blade. However, it is to be noted that the segment region could define a radially inner integral platform on the turbine blade.

Alternatively, the cooled component can take the form of a nozzle guide vane, wherein said segment region defines a radially inner or outer shroud portion (platform) of said nozzle guide vane.

In another embodiment, the cooled component takes the form of a seal segment.

In preferred arrangements, the or each said flow passage opens into said slot via a respective flow aperture.

Preferably, said slot has a width approximately equal to the diameter of the or each flow aperture. Alternatively, the slot has a width which is between approximately 1.2 and 1.7 times the diameter of the or each flow aperture.

It is proposed that the cooled component of the present invention may comprise at least one said flow passage arranged to open into said slot via a flow aperture located in the operationally upstream half of the side face.

The component may comprise at least one said flow passage arranged to open into said slot via a flow aperture located in the region of the operationally upstream end of the side face.

It is furthermore envisaged that the component may comprise at least one said flow passage arranged to open into said slot via a flow aperture located in the operationally downstream half of the side face.

In preferred arrangements, the component may be configured so as to comprise a plurality of said flow passages arranged within said segment region such that their respective flow apertures are spaced from one another along said slot.

Such an arrangement may comprise a single said cooling slot provided in a first of said side faces and wherein said flow passages define a first set of flow passages. The component may further comprise a plurality of additional flow passages defining a second set of flow passages within said segment region, the flow passages of said second set terminating with respective spaced apart flow apertures formed along the second of said side faces.

Alternatively, it is proposed to provide a component comprising a first said cooling slot provided in a first of said side faces, and a second said cooling slot provided in the second of said side faces, wherein the segment region comprises a first set of said flow passages opening into said first slot via respective spaced apart flow apertures, and wherein the segment region further comprises a second set of flow passages opening into said second slot via respective spaced apart flow apertures.

In accordance with another aspect of the present invention, there is provided a pair of cooled components of the alternative arrangements proposed above, provided in combination, each said component being configured such that when the components are arranged operationally and circumferentially adjacent one another with the first side face of one component lying substantially adjacent the second side face of the other component, the flow apertures of the first set of flow passages associated with said first side face lie in alternating relation to the flow apertures of the second set of flow passages associated with said second side face, along the or each said slot.

So that the invention may be more readily understood, and so that further features thereof may be appreciated, embodiments of the invention will now be described by way of example with reference to the accompanying drawings in which.

Figure 1:
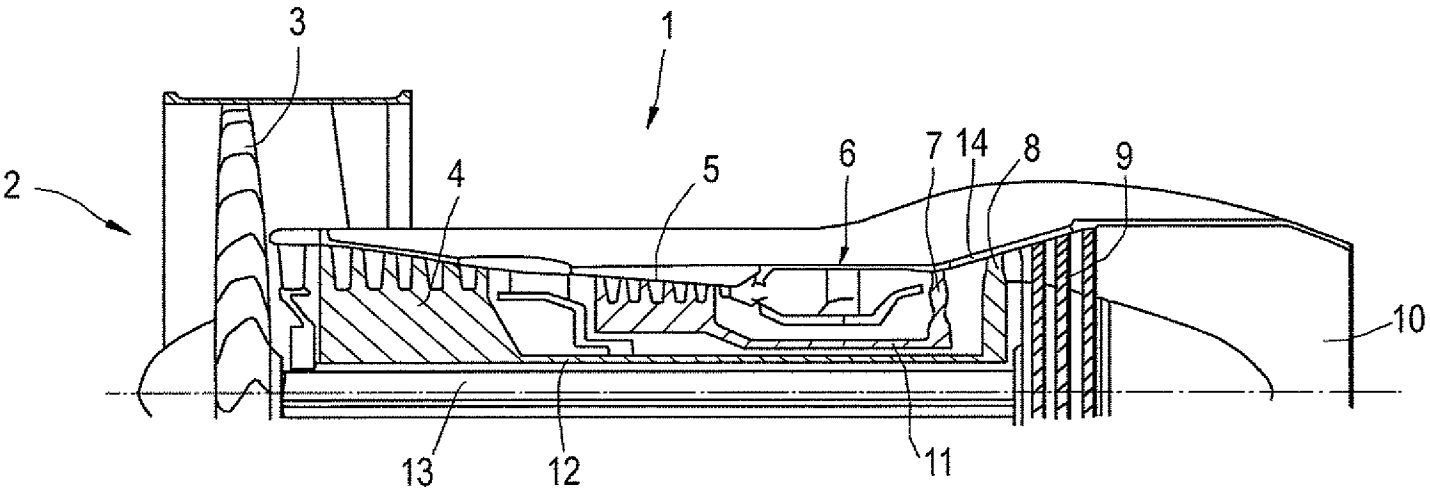
FIG. 1 is a transverse cross-sectional view of the upper half of a gas turbine engine.

Referring now in more detail to FIG. 1, there is illustrated a gas turbine engine 1 which comprises, in axial flow series, an intake 2, a propulsive fan 3, an intermediate pressure compressor 4, a high pressure compressor 5, combustion equipment 6, and a turbine arrangement comprising a high pressure turbine 7, an intermediate pressure turbine 8 and a low pressure turbine 9, downstream of which is provided an exhaust nozzle 10.

The gas turbine engine 1 operates in a conventional manner such that air entering the intake 2 is accelerated by the propulsive fan 3 which produces two air flows, namely a first air flow which is directed into the intermediate pressure compressor 4, and a second air flow which bypasses the intermediate pressure compressor 4 and provides propulsive thrust. The intermediate pressure compressor 4 compresses the first air flow before delivering the resulting compressed air to the high pressure compressor 5 where further compression takes place. The compressed air exhausted from the high pressure compressor 5 is directed into the combustion equipment 6 where it is mixed with fuel and the resulting mixture is combusted. The resulting hot combustion products then expand through, and thereby drive, the high, intermediate and low pressure turbines 7, 8, 9 before being exhausted through the nozzle 10 to provide an additional component of propulsive thrust. The high, intermediate and low pressure turbines 7, 8, 9 respectively drive the high and intermediate pressure compressors 4, 5 and the fan 3, via respective coaxial interconnecting shafts 11, 12, 13.

Figure 2:
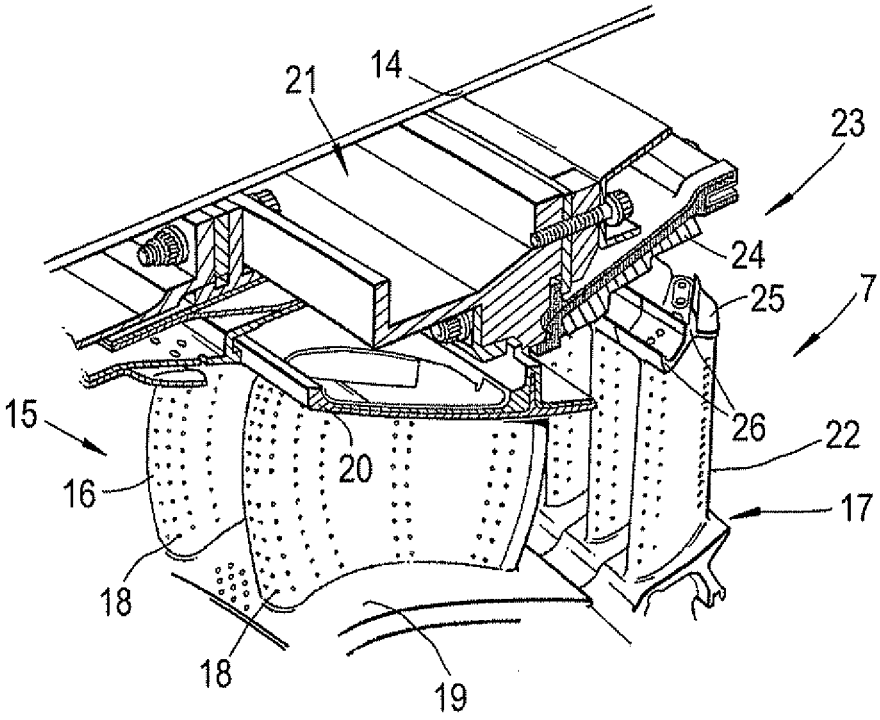
FIG. 2 is a perspective view of part of a turbine of the engine.

Referring now to FIG. 2, there is illustrated part of the high pressure turbine 7 which is shown in the form of a single stage turbine and which is connected to, and drives, the high pressure compressor 5 via the shaft 11. Nevertheless, it should be appreciated that the turbine could alternatively take the form of a multiple stage turbine, for example a two-stage turbine. A casing 14 extends around the high pressure turbine 7 and also extends around the intermediate and low pressure turbines 8, 9.

The turbine 7 comprises a stator assembly indicated generally at 15 and which takes the form of an annular array of fixed nozzle guide vanes 16 arranged upstream of a rotor assembly 17. FIG. 2 actually illustrates only a single nozzle guide vane 16 which comprises a pair of circumferentially spaced apart aerofoil blades 18 interconnected at their radially inner and outer ends by respective shroud segments 19, 20. A support structure 21 for the nozzle guide vanes 16 extends circumferentially around the array of nozzle guide vanes 16 which are fixedly mounted on the support structure 21.

As will be explained in more detail below, the rotor assembly 17 comprises an annular array of turbine blades 22. A wall structure or seal segment assembly 23 is shown schematically in FIG. 2 and extends circumferentially around the array of turbine blades 22. The seal segment assembly 23 comprises a plurality of seal segments 24 which are arranged so as to together define the annular seal segment assembly 23. As will be explained in more detail below, each turbine blade 22 is provided with a shroud segment 25 at its radially outermost tip, and a platform at it. The shroud segments 25 each comprise a number of generally radially outwardly directed ribs or other projections 26.

As will be appreciated, the intermediate and low pressure turbines 8, 9 also comprise similar arrangements of nozzle guide vanes, seal segments, and rotor blades.

Figure 3:
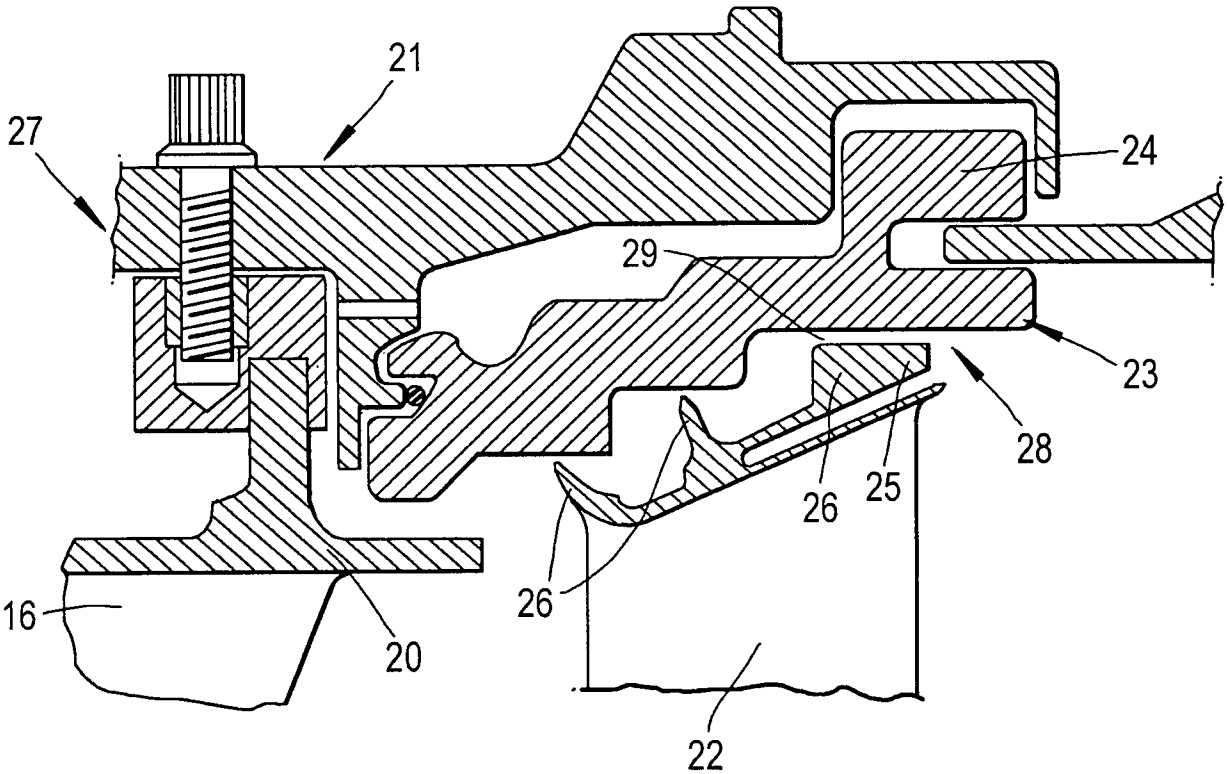
FIG. 3 is a vertical cross-section through part of the turbine arrangement shown in FIG. 2.

Turning now to consider FIG. 3, there is illustrated in schematic form a sectional view through part of the high pressure turbine 7 shown in FIG. 2. FIG. 3 shows in detail the support structure 21 for the nozzle guide vanes 16. The support structure 21 supports the guide vanes in a known manner through first mounting means 27 at the downstream end region of the array of nozzle guide vanes 16, and further mounting means (not shown) at the upstream end region. In the arrangement illustrated, the support structure 21 also supports the seal segment assembly 23 which extends circumferentially around the array of turbine blades 22. As indicated above, the seal segment assembly 23 comprises a plurality of circumferentially adjacent seal segments 24, only one of which is illustrated in FIG. 3.

The seal segment assembly 23 is arranged in substantial radial alignment with the turbine blades 22 such that a small clearance gap 28 is defined between the shroud segments 25 of the turbine blades 22 and the seal segment assembly 23. Each seal segment 24 has an inner surface 29 having a profile which corresponds generally to the radially outwardly presented profile of the shroud segments 25 of the turbine blades 22. Thus, it will be seen that the inner surface 29 of the seal segment 24 has a stepped profile so as to define regions arranged in closely spaced relation to respective ribs or projections 26 of the shroud segment 25.

Figure 4:
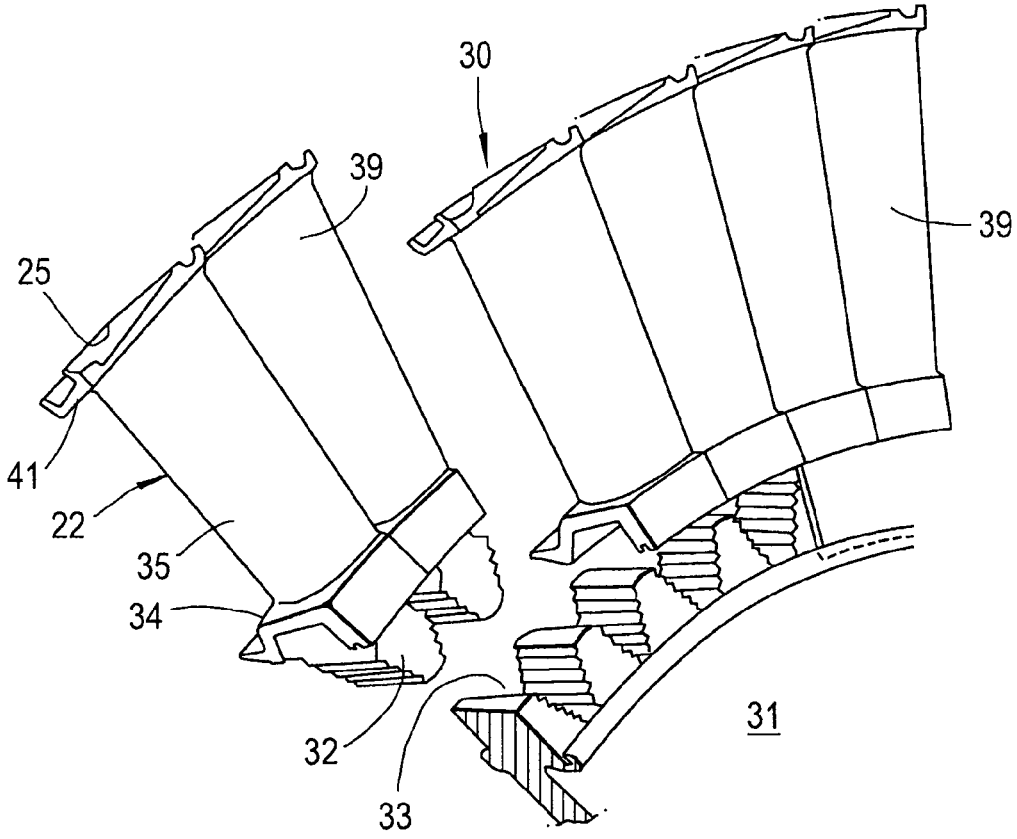
FIG. 4 is a perspective view of part of a turbine rotor forming part of the turbine arrangement illustrated in FIGS. 2 and 3, showing the rotor from its downstream side and in a partly disassembled condition.

Turning now to consider FIGS. 4 and 5, the configuration of the individual turbine blades 22, and in particular their radially outermost shroud segments 25, will now be described in more detail. FIG. 4 illustrates the single rotor stage 30 of the high pressure turbine 7, the rotor stage comprising a rotor disc 31 to which the plurality of radially extending turbine blades 22 are mounted. Each turbine blade 22 comprises a root portion 32, having a so-called "fir-tree" sectional shape which is configured to locate in a respective and correspondingly shaped slot 33 provided in the periphery of the rotor disc 31. Each turbine blade 22 further comprises a radially inner platform 34 which abuts the corresponding platforms of neighbouring blades in order to define the inner wall of a gas passage for the turbine. Extending radially outwardly from the platform 34 is an aerofoil section 35 which supports the shroud segment 25 at its radially outermost end.

Figure 5:
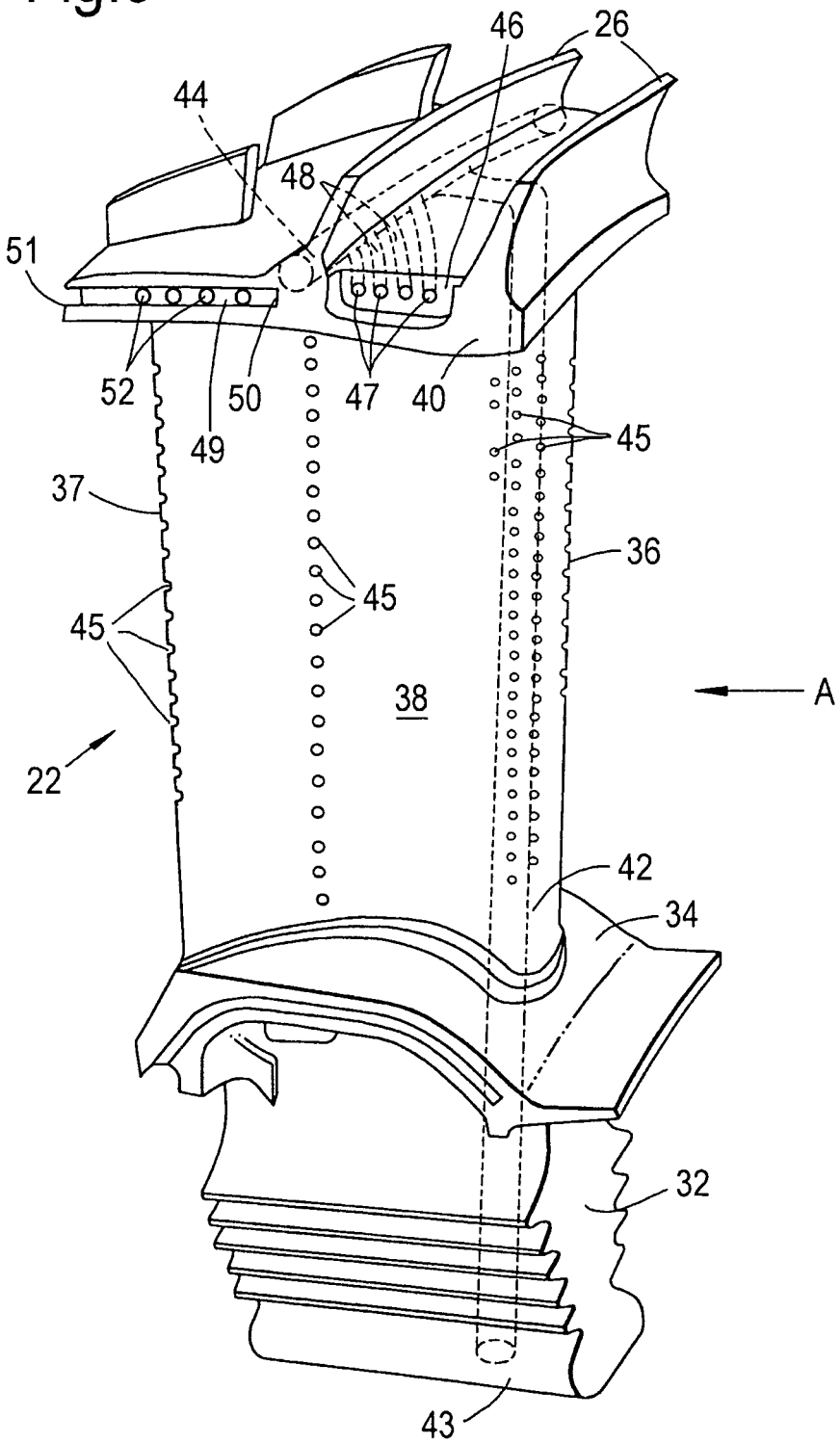
FIG. 5 is a perspective view of a turbine blade in accordance with an embodiment of the present invention, as viewed from its leading edge.

FIG. 5 illustrates an individual turbine blade 22 in further detail, as viewed from the front (relative to the axial flow direction A of the hot gasses through the turbine). As will therefore be seen, the aerofoil 35 comprises a leading edge 36 and a trailing edge 37 in a generally conventional manner. FIG. 5 clearly illustrates the concave (pressure) surface 38 of the aerofoil whilst FIG. 4, which illustrates each turbine blade 22 as viewed from the rear, clearly shows the oppositely directed convex (suction) surface 39 of each aerofoil 35.

The shroud segment 25 of the turbine blade 22 extends to either side of the aerofoil section 35 and terminates with opposed side faces 40 (illustrated in FIG. 5) and 41 (illustrated in FIG. 4). As thus will be appreciated, the side face 40 is provided on the concave (pressure) side of the turbine blade, whilst the opposed side face 41 is provided on the convex (suction) side of the turbine blade. When the plurality of turbine blades 22 are installed in the rotor, each side face 40, 41 of each shroud segment 25 lies substantially adjacent, and preferably abuts, a respective corresponding side face of the adjacent shroud portion provided at the end of the neighbouring turbine blade. In this manner, the plurality of adjacent shroud sections 25 cooperate to define an annulus which represents an outer wall of a gas passage through the turbine section of the engine.

Referring again to FIG. 5, it will be seen that the turbine blade 22 is provided with at least one internal flow passage 42 extending radially outwardly, from an inlet port 43 provided at the bottom of the root portion 32. The flow passage 42 extends from the inlet 43, through the root portion 32, through the platform 34, through the entire length of the aerofoil section 35 and into the structure of the shroud segment 25. At its radially outermost end, the internal flow passage 42 is provided in fluid communication with a generally circumferentially extending flow duct 44 provided within the shroud segment 25 so as to extend substantially along the length of the shroud section 25. However, it is to be appreciated that the flow duct 44 is closed at each end so as not to extend through the opposed side faces 40, 41 of the shroud segment. As also illustrated in FIG. 5, the aerofoil section 35 of the turbine blade is provided with a plurality of small air exit holes 45 provided through the concave (pressure) surface of the aerofoil, each air exit hole 45 being provided in fluid communication with the internal flow passage 42.

During operation of the turbine, a flow of relatively cool air is drawn from the compressor stage of the engine and fed to the inlet apertures 43 of each turbine blade 22. The flow of cooling air is thus directed radially outwardly along each internal flow passage 42 and a plurality of fine jets of cooling air are directed through the air exit holes so as to wash the pressure surface of the aerofoil section 35 with cooling air. The flow of cooling air is also directed into the circumferential flow duct 44 provided within each turbine shroud segment 25, and in so doing serves to cool the shroud segment 25. However, the shroud 25 is provided with further cooling features as will be described below.

Figure 6:
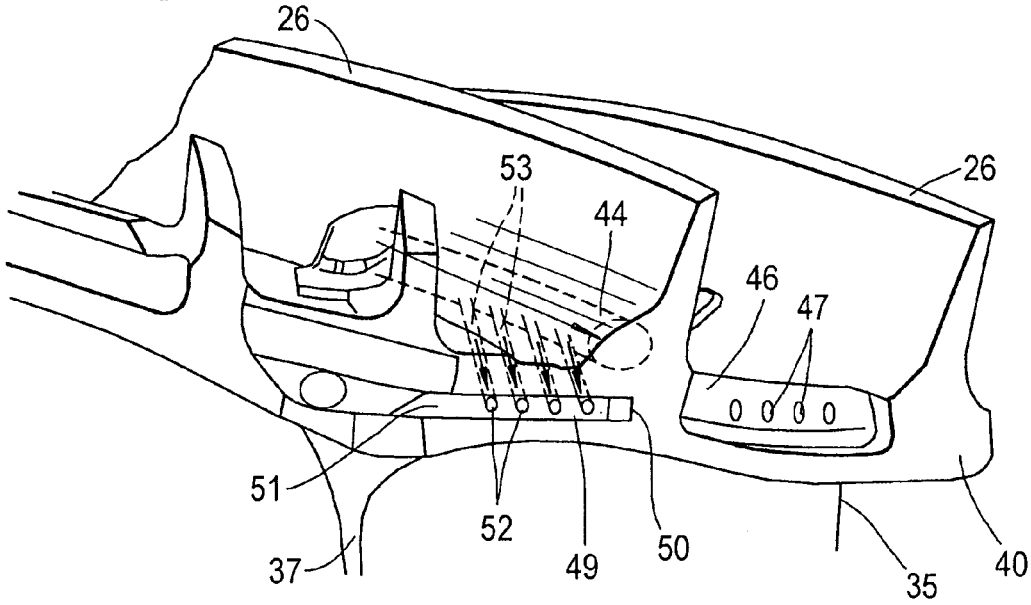
FIG. 6 is an enlarged view of the shroud region of the turbine blade shown in FIG. 5, but viewed from the trailing edge of the blade.

The particular shroud segment 25 illustrated in FIGS. 5 and 6 is provided with two arrangements arranged to cool the side face 40. In the upstream region of the shroud segment 25 (i.e. the region located towards the leading edge 36 of the turbine blade), there is provided a recess 46 which extends inwardly from the side face 40. The recess 46 is open along its length, both towards the side of the shroud segment and towards the radially outermost surface of the shroud segment. A plurality of air outlet holes 47 are provided in the recess, each of which is in fluid communication with the flow duct 44 via respective flow passages 48 (shown in FIG. 5) extending within the structure of the shroud segment.

As will be appreciated, when the side face 40 of the illustrated shroud segment 25 is provided in abutting relationship with the side face 41 of an adjacent shroud segment, the open side of the recess 46 is effectively closed by the adjacent side face 41, leaving the recess open along its top. During operation, cooling air is directed into the recess 46 via the air outlet holes 47, thereby cooling the side region of the side segment 25, but also so as to impinge against, and hence cool, the adjacent side face 41 of the neighbouring turbine blade. The cooling air is exhausted from the recess 46 through the open top of the recess. The aforementioned cooling recess 46 is generally conventional in form and operation.

However, the shroud segment 25 illustrated in FIG. 5 (and illustrated in larger scale in FIG. 6) also comprises an additional cooling arrangement in the downstream region of the side face 40. In particular, it will be seen that the side face 40 is provided with an elongate cooling slot 49 extending from a generally upstream end 50 located generally halfway along the side wall 40, to a downstream end 51 located at the extreme downstream end of the side face 40. The cooling slot 50 extends inwardly from the side face 40 in a generally similar manner to the recess 46. However, the cooling slot 49, in contrast to the recess 46, is not open along its top region. As illustrated in FIGS. 5 and 6, the cooling slot 49 is open along its length. Additionally, because the cooling slot 49 extends all the way to the extreme downstream end of the side wall 40, the cooling slot is also open at its downstream end 51.

A plurality of flow apertures 52, in the form of outlet holes are provided at spaced-apart locations along the length of the slot, each flow aperture 52 being fluidly connected via a respective flow passage 53 (illustrated in FIG. 6) with the internal flow duct 44. In the preferred arrangement, the width of the cooling slot 49 (as measured generally radially with respect to the orientation of the turbine blade) is approximately equal to the diameter of the flow apertures 52. However, it is to be appreciated that manufacturing tolerances may not always permit such a close match in dimension between the slot width and the flow aperture diameter. In the case of a typical turbine blade for an aero-engine, it is envisaged that the flow apertures will typically have a diameter in the range of 0.3 to 0.5 mm, with the cooling slot 49 having a width approximately equal to between 1.2 and 1.7 times the aperture diameter. On larger blades, such as those used in industrial gas turbines engines, the flow apertures and cooling slots are likely to be larger.

Figure 7:
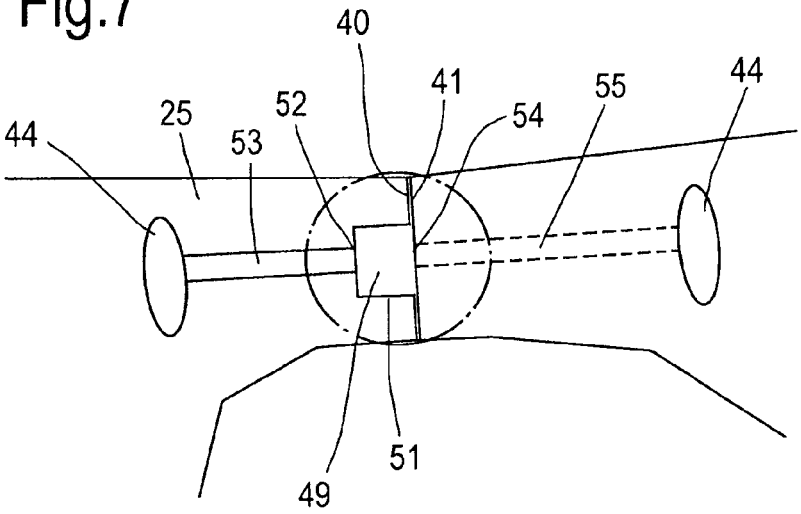
FIG. 7 is a schematic, part-sectional view, showing the interface between the shroud regions of two adjacent turbine blades.

As will be appreciated, when the side face 40 of the illustrated shroud segment 25 is provided in abutting relationship with a side face 41 of an adjacent shroud segment, as illustrated schematically in FIG. 7, the open side of the cooling slot 49 is effectively closed by the adjacent side face 41, leaving the slot open only in the region of its downstream end 51. During operation, cooling air is directed into the cooling slot 49 via the flow passages 53 and their associated flow apertures 52, thereby cooling the material of the shroud segment in the region of the cooling slot, but also so as to impinge against, and hence cool, the adjacent side face 41 of the neighbouring turbine blade. The cooling air is then exhausted from the cooling slot 49 through the downstream open end 51.

Figure 8:
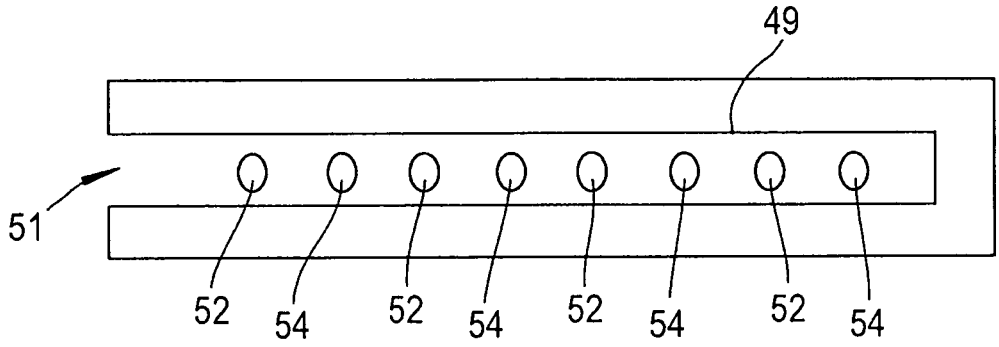
FIG. 8 is an enlarged illustration showing a cooling slot formed in the shroud of the turbine blade.

Additionally, it is proposed to provide the shroud segment 25 with an additional set of flow passages extending from the internal flow duct 44 and terminating with respective flow apertures provided in the opposing side face 41. For example, FIG. 7 illustrates in schematic form one such flow passage 55 extending from the internal flow duct 44 of the adjacent shroud segment 25 and terminating in a flow aperture 54. As will be appreciated, when the two shroud segments are aligned with one another and provided in abutting relationship as illustrated in FIG. 7, the flow aperture 54 opens into the cooling slot 49 provided in the adjacent shroud segment. Furthermore, as illustrated schematically in FIG. 8, it is proposed that the additional flow passages and associated flow apertures extending towards the opposed side face 41 will be offset relative to the first set of flow passages and flow apertures provided in the slot 49. In this manner, when the neighbouring shroud segments are provided in abutting relationship, the flow apertures 54 provided at the end of the flow passages 55 extending towards the convex side 39 of the adjacent turbine blade will lie between neighbouring flow apertures 52 provided at the end of the flow passages 53 extending towards the convex side of the turbine blade. In other words, as illustrated in FIG. 8, the two sets of flow apertures 52, 54 are provided in alternating relation. As will be appreciated, during operation of such an arrangement, cooling air is directed into the slot 49 from both sides, entering the slot through the first set of flow apertures 52 on one side and through the second set of flow apertures 54 on the other side. The cooling jet of air produced by each of the first set of flow apertures 52 will thus impinge on a region of the neighbouring side wall 41 located between adjacent flow apertures 54, and similarly the jets of cooling air produced by each of the second set of flow apertures 54 will impinge on the inner surface of the slot 49, between adjacent flow apertures 52. This alternating relationship between the two sets of cooling apertures opening into the cooling slot from either side prevents the cooling flow of air being choked, and also maximises the impingement cooling effect of the respective cooling air jets.

Figure 9:
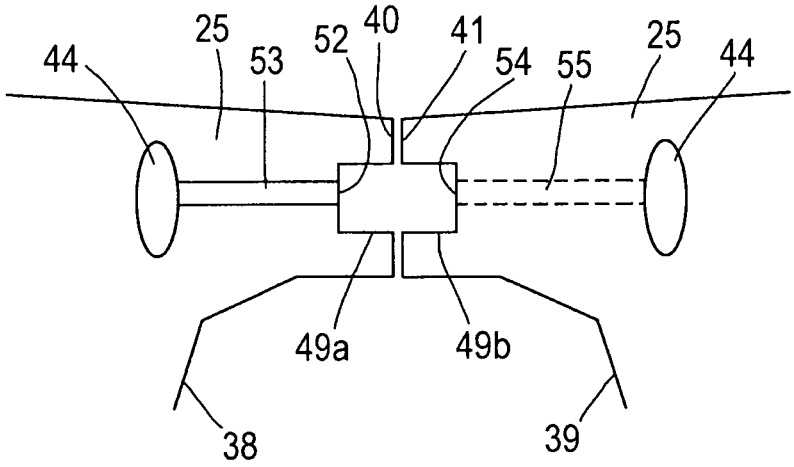
FIG. 9 is a view corresponding generally to that of FIG. 7, but showing the interface between two turbine blades of alternative configuration.

FIG. 9 illustrates a modified arrangement in which both side faces 40, 41 of each shroud segment is provided with a corresponding cooling slot 49*a*, 49*b* such that when the neighbouring shroud segments 25 are provided in abutting relation to one another, the two slots are aligned with one another. As illustrated in FIG. 9, in such an arrangement the first set of flow passages 53 which extend from the internal flow duct 44 towards the convex side of the turbine blade will open into the first cooling slot 49*a* via the first set of flow apertures 52, whilst the second set of flow passages 55 will extend from the internal flow duct 44 towards the concave side of the turbine blade and will open into the first cooling slot 49*a* via the first set of flow apertures 52, whilst the second set of flow passages 55 will extend from the internal flow duct 44 towards the concave side of the turbine blade so as to open into the opposite cooling slot 49*b* via the second set of flow apertures 54. In such an arrangement, it is envisaged that the first and second sets of flow passages will again be offset relative to one another so that the first and second flow apertures have the same offset relationship as illustrated in FIG. 8.

Figure 10:
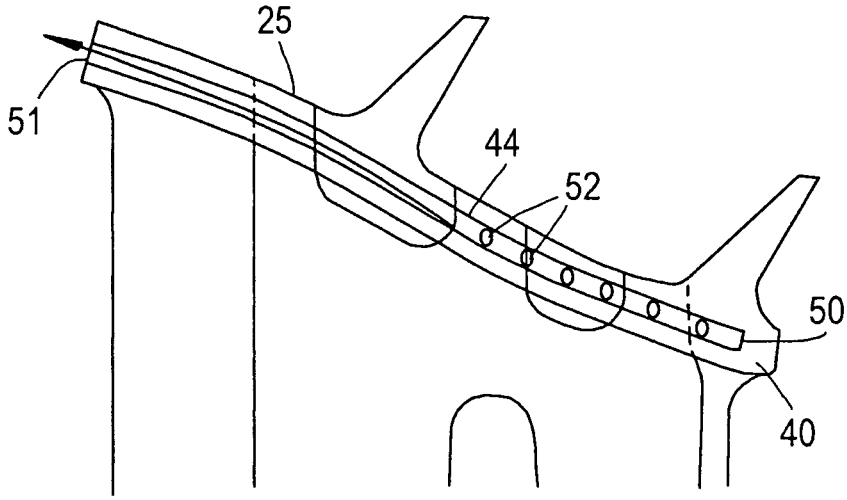
FIG. 10 is a schematic illustration showing the configuration of an alternative cooling slot formed in the shroud of a turbine blade.
Figure 11:
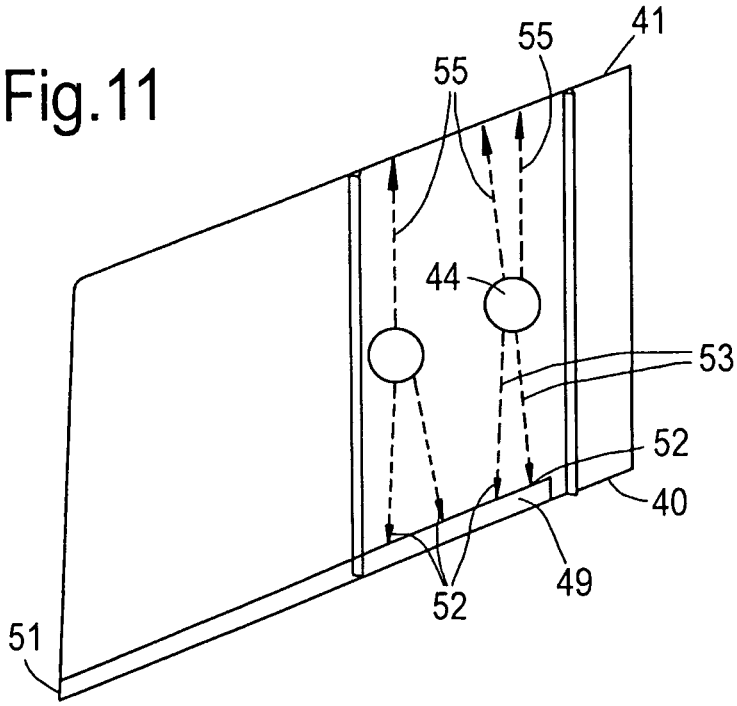
FIG. 11 is a part-sectional view illustrating the shroud region of the turbine blade illustrated in FIG. 10, as viewed from above.

Whilst the invention has been described above with specific reference to an arrangement in which the or each cooling slot 49 is provided in the downstream region of the shroud segment 25, in variants of the invention, it is envisaged that the cooling slot 49 may extend towards the upstream region of the shroud segment 25, for example as illustrated in FIG. 10. In the arrangement illustrated in FIG. 10, the conventional cooling recess 46 has been replaced by a cooling slot 49 of increased length such that the upstream end 50 of the cooling slot is located in the upstream region of the side wall 40. In the arrangement illustrated, the flow apertures 52 opening into the cooling slot are also provided in the upstream region of the shroud segment 25.

It should be noted that the cooling slot 49 of each blade shroud is open in the circumferential direction, however, in use, cooling slots 49 of adjacent blades abut to define an outlet downstream as indicated at 51. An adjacent blade does not necessarily require a cooling slot 49 as a blank shroud surface abutting another cooling slot will still form the outlet. Some coolant might emerge radially inwardly and outwardly from between adjacent blades depending on tolerances and sealing. This can be desirable in certain circumstances.

Figure 12:
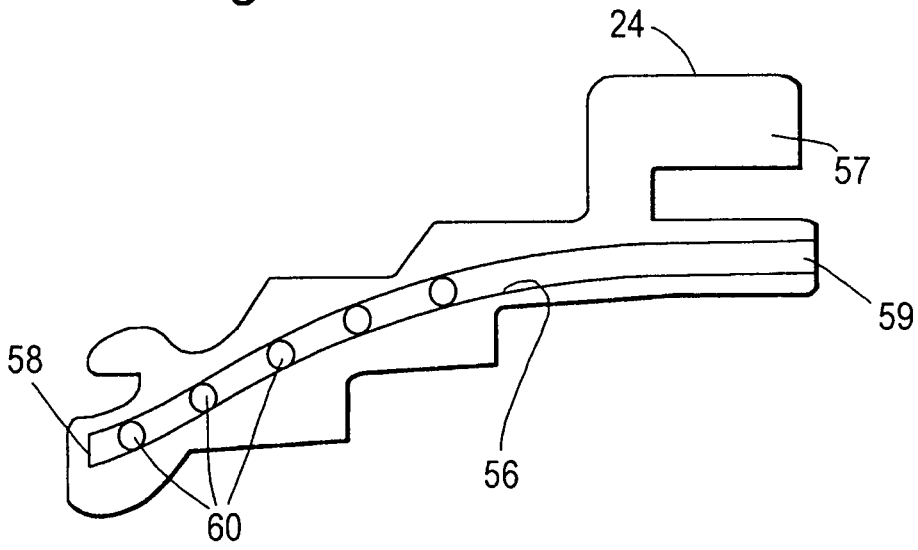
FIG. 12 is cross sectional view through a seal segment embodying the present invention.

Furthermore, whilst the invention has been described above with specific reference to the provision of a cooling slot in the side face of a turbine blade shroud segment 25, it is to be appreciated that the cooling slot of the present invention could similarly be used to cool the radially inner platform 34 of a turbine blade, or the inner or outer shroud segments 19, 20 of the nozzle guide vanes in a substantially identical manner. Furthermore, as illustrated in FIG. 12, it is also possible to use a cooling slot of the general type described above in order to cool the seal segments 24 of the turbine. For example, FIG. 12 illustrates a cooling slot 56 provided in the side face 57 of a seal segment 24. The cooling slot 56 has a substantially identical configuration to the cooling slots 49 described above in the context of turbine blade shroud segments, and in particular has a closed upstream end 58 and an open downstream end 59 at the extreme downstream end of the side face 57, in order to define an outlet for the cooling fluid which is flowed into the cooling slot via the spaced-apart flow apertures 60.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A cooled component for a gas turbine engine, the component comprising:

a segment region defining a segment of an annulus for passage of hot gases therethrough, said segment region having a pair of opposed side faces configured to lie substantially adjacent respective corresponding side faces of the segments of similar operationally and circumferentially adjacent components, wherein:

the segment region includes an elongate cooling slot in at least one of said side faces, said cooling slot being arranged in fluid communication with at least one flow passage within said segment region for a supply of cooling fluid to said slot, the slot is substantially closed at an upstream end of the slot and open at a downstream end of the slot so as to define an outlet for said cooling fluid at an operationally downstream region of said at least one of said side faces, and the slot is open along a length of the slot such that, in use, the cooling fluid can travel along the length of the slot and impinge against a segment region of an adjacent component.

2. A cooled component according to claim 1 wherein the component is a turbine blade and said segment region defines an integral shroud portion of the blade.

3. A cooled component according to claim 1 wherein the component is a turbine blade and said segment region defines an integral radially inner platform of the blade.

4. A cooled component according to claim 1 wherein the component is a nozzle guide vane and said segment region defines a shroud portion of said nozzle guide vane.

5. A cooled component according to claim 1 wherein the component is a seal segment.

6. A cooled component according to claim 1, wherein at least one of the at least one flow passage opens into said slot via a respective flow aperture.

7. A cooled component according to claim 6, wherein said slot has a width approximately equal to a diameter of the flow aperture.

8. A cooled component according to claim 6, wherein said slot has a width which is between approximately 1.2 and 1.7 times a diameter of the flow aperture.

9. A cooled component according to claim 1, wherein at least one of the at least one flow passage is arranged to open into said slot via a flow aperture located in an operationally upstream half of the at least one of said side faces.

10. A cooled component according to claim 9, wherein a plurality of flow passages are used, and at least one flow passage is arranged to open into said slot via a flow aperture located in a region of an operationally upstream end of the at least one of said side faces.

11. A cooled component according to claim 1 wherein at least one of the at least one flow passage is arranged to open into said slot via a flow aperture located in an operationally downstream half of the at least one of said side faces.

12. A cooled component according to claim 1 wherein a plurality of flow passages are used with a respective flow aperture at an end of each flow passage, and the flow apertures are spaced from one another along said slot.

13. A cooled component according to claim 12 wherein:

the slot is a single slot provided in a first side face of said side faces, said flow passages define a first set of flow passages, the component further includes a plurality of additional flow passages defining a second set of flow passages within said segment region, and the flow passages of said second set of flow passages terminating with respective spaced apart flow apertures formed along a second side face of said side faces.

14. A cooled component according to claim 12 wherein:

the slot in the at least one of said side faces includes a first cooling slot provided in a first side face of said side faces, and a second cooling slot provided in a second side face of said side faces, and the segment region comprises a first set of said flow passages of the plurality of flow passages opening into said first slot via respective spaced apart flow apertures, and the segment region further comprises a second set of said flow passages of the plurality of flow passages opening into said second slot via respective spaced apart flow apertures.

15. A pair of cooled components according to claim 13 provided in combination, each said component being configured such that when the components are arranged operationally and circumferentially adjacent one another with the first side face of one component lying substantially adjacent the second side face of the other component, the flow apertures of the first set of flow passages associated with said first side face lie in alternating relation to the flow apertures of the second set of flow passages associated with said second side face, along said slot.

* * * * *